US005577726A

United States Patent [19]

Fenton

[11] Patent Number: 5,577,726

[45] Date of Patent: Nov. 26, 1996

[54] ADJUSTABLE LIE PUTTER

[76] Inventor: Frank Fenton, 5358 Dominica Cir., Sarasota, Fla. 34233

[21] Appl. No.: 404,760

[22] Filed: Mar. 15, 1995

[51] Int. Cl.[6] ..... A63B 53/02

[52] U.S. Cl. ..... 473/305; 473/340

[58] Field of Search ..... 273/77 R, 79, 273/80.1–80.9; 403/104, 106–108

[56] References Cited

U.S. PATENT DOCUMENTS

| | | | |
|---|---|---|---|
| 1,599,336 | 9/1926 | Lindgren | 273/168 |
| 2,661,952 | 12/1953 | Jackson | 273/173 |
| 3,204,962 | 9/1965 | McCormick | 273/80.1 |
| 5,308,063 | 5/1994 | Vendur | 273/80.1 |
| 5,390,918 | 2/1995 | Meyers | 273/80.1 |
| 5,390,919 | 2/1995 | Stubbs et al. | 273/80.1 |

FOREIGN PATENT DOCUMENTS

| | | | |
|---|---|---|---|
| 9006157 | 6/1990 | WIPO | 273/80.1 |

*Primary Examiner*—Steven Wong
*Attorney, Agent, or Firm*—Aquilino & Welsh

[57] ABSTRACT

A putter type golf club includes an arrangement for altering the lie angle between the shaft and the club head body. The hosel is formed with a lower flange member which fits into and is pivotably moveable within a slot formed in the top of the club head body. A set screw, cooperating with a series of depressions, locks the hosel flange member in a preselected position.

3 Claims, 1 Drawing Sheet

ADJUSTABLE LIE PUTTER

BACKGROUND AND SUMMARY OF THE INVENTION

The present invention relates to golf clubs, and more particularly, to a golf putter having a club head which has an adjustable lie structure.

Adjustable golf clubs, including putters, have been known in the patent art. However, in order to conform with the rules of golf as defined by the United States Golf Association (U.S.G.A.), a golf club may not be adjustable during the playing of a round of golf. Many of the prior art devices permit adjustability at any time, and therefore, while they may be used in friendly rounds of golf or for practice, these clubs are not available for competitions sanctioned under the rules of the U.S.G.A.

Prior art adjustable putters are shown in the following patents: Hartford U.S. Pat. No. 1,331,499, Olson U.S. Pat. No. 1,352,020, Allen U.S. Pat. No. 1,486,823, Barnes U.S. Pat. No. 1,535,707, Melanson et al U.S. Pat. No. 5,244,205, Stubbs et al U.S. Pat. No. 5,390,919 and Great Britian (9169-1908) among others.

It will be appreciated that an adjustable golf Club is able to be used by a wider variety of players. This particularly applies to putters, since there is no recommended standard for the stance and stroke of a putt.

The present invention is directed to a golf putter having a club head member which may be adjusted so that the lie angle with respect to the shaft is moveable to accommodate a wide variety of golfers and individual golf strokes. The club is particularly unique in that once an adjustable position is found, a locking set screw may be tightened to secure the putter in a rigid, fixed position, thereby allowing it to be used in competitions sanctioned by the U.S.G.A. To achieve the adjustable feature, the hosel includes an elongated, flat flange which fits into a slot; machined, cast or otherwise formed in the top surface of the putter head. The end of the hosel flange includes a hole through which a flange pin is inserted, thereby pivotably connecting the hosel flange to the club head body. A series of set screw indentations is positioned on the hosel flange above the flange pin and cooperates with a locking set screw secured to the back surface of the putter head through a threaded opening. Preferably, the size and structure of the slot and flange will permit the lie angle to be adjusted within a range of 15°–20°.

Once a precise lie angle is obtained, the locking set screw is tightened and the end of the screw engages one of the said screw depressions to firmly lock the hosel flange in the preselected position. Subsequent adjustments may be made by simply loosening the locking set screw and pivoting the shaft on the shaft pin.

Among the objects of the present invention are the provision of a golf putter which may be adjusted to a variety of angular lie positions.

Another object of the present invention is the provision of an adjustable putter wherein the adjustments may be locked in place so as to be nonmoveable during the playing of a round of golf.

A still further object of the present invention is the provision of an adjustable putter which is equally applicable to a wide variety of shapes of golf putter heads with no limitations as to size or form thereof.

These and other objects of the present invention will become apparent with reference to the following detailed description of the invention and claims, and to the accompanying drawings.

DESCRIPTION OF THE PREFERRED EMBODIMENTS

Figure 1:
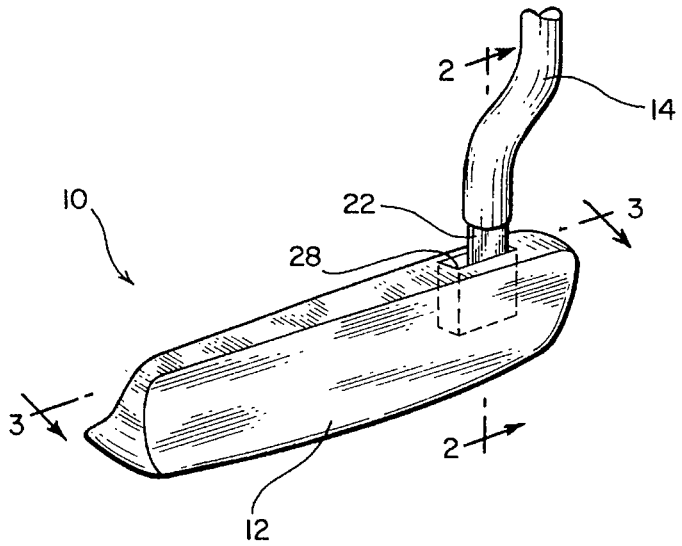
FIG. 1 is a perspective view of a golf putter in accordance with the present invention.
Figure 4:
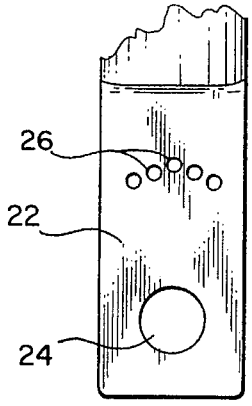
FIG. 4 is a view of a detail of the hosel flange of the present invention.
Figure 2:
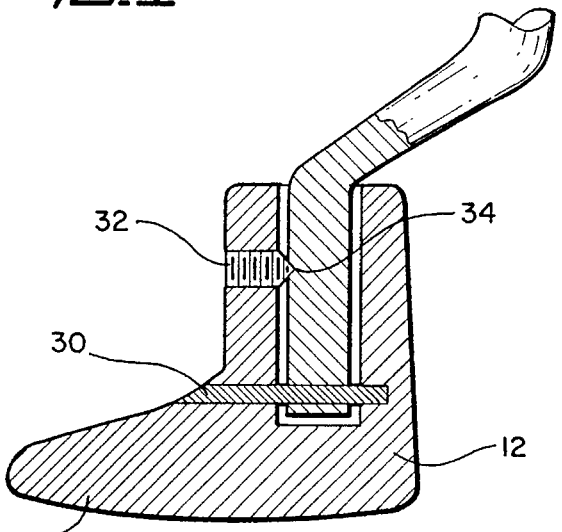
FIG. 2 is an end sectional view taken along the lines 2—2 of FIG. 1.
Figure 3:
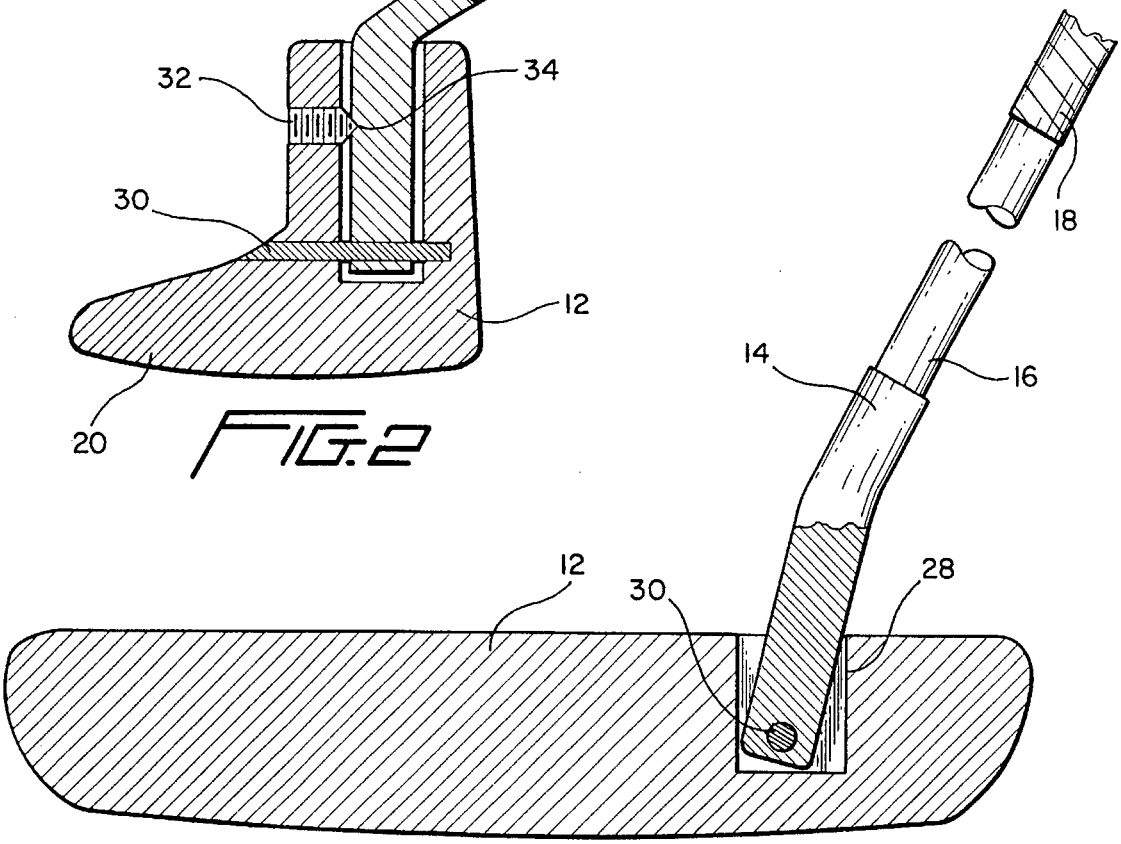
FIG. 3 is a front elevational view taken along the lines 3—3 of FIG. 1.

Reference will now be made in the detail to a preferred embodiment of the invention, an example of which is illustrated in the accompanying drawings.

Referring to the drawings, a golf putter 10 of the present invention is formed with a club head body 12, a hosel 14, shaft 16 and handle or grip 18. The club head body 12 is shown to be a blade type with a rearwardly extending flange 20. However, it will be appreciated that the invention, as described, is equally applicable to any size or shape of putter type club head, including both right and left handed models. The hosel 14 includes a generally flattened, lower flange 22. A rounded bore opening 24 is formed within a lower area of the flange 22. The hosel flange 22 includes a series of depressions 26 located above the bore opening 24 and below the main body of the hosel 14. The hosel flange 22 is designed to fit within an elongated, rectangular slot 28 formed in the upper surface of the putter head body 12. A flange pin 30 extends through the putter head body 12 into the bore opening 24 on the flange to fix the hosel 14 to the club head body 12, while permitting pivotal movement of the hosel flange 22 about the flange pin 30 so that the lie angle of the shaft 16 and grip 18 may be adjusted relative to the putter head body 12. Preferably, the flange pin will provide a snug fit within the bore opening 24 so that the relative position of the shaft 16 and putter head 12 body may be maintained, while a golfer checks the position of the putter relative to his stance and putting stroke.

A locking set screw 32 having a pointed end 34 cooperates with the set screw depressions 26. When an optimum position is found, the locking set screw 32 is tightened so that the end 34 of the screw fits into one of the set screw depressions 26, thereby locking the shaft 16 in place relative to the putter head body 12 when the screw 32 is tightened.

It will be appreciated that the lie angle of the putter may be readjusted simply by loosening the locking set screw 32, thereby removing the end 34 of the screw from the depression 26 in which it lies, thereby allowing pivotable adjustment of the hosel flange 22 within the slot 28, as described hereinabove.

It will be apparent to those skilled in the art that other modification and variations can be made in the putter type golf club of the present invention without departing from the spirit or scope of the invention. Thus, it is intended that the invention cover modifications and variations of this invention, provided these come within the scope of the appended claims and their equivalents.

I claim:

1. A putter type golf club including a shaft with a handle, a hosel and a club head body wherein the improvement comprises means for altering the lie angle between said shaft and said club head body:

said means including a slot formed in said club head body and a flange member on a lower portion of said hosel, structured and sized to fit within said slot;

said flange member including a bore opening;

said club head body including a pin member passing through said club head body into said bore opening in said flange member, fixing said flange relative to said club head body within said slot and allowing pivotal movement of said flange relative to said club head body around said pin; and, a locking means connected to said club head body and cooperating with said flange member, permitting said flange member to be locked in a preselected position, creating a preselected lie angle between said shaft and said club head body; said locking means including an opening formed in said club head body and a single locking member positioned within said opening in said club head body; said single locking member having an end cooperating with one of a series of depressions formed in said flange member above said pin.

2. The golf club of claim 1 wherein said single locking member is a threaded set screw and said opening in said body is threaded to cooperate with said set screw.

3. The golf club of claim 1 wherein said shaft is pivotable within a range of 15–20 degrees relative to said club head body.

* * * * *